US007370421B2

(12) United States Patent
Onion et al.

(10) Patent No.: US 7,370,421 B2
(45) Date of Patent: May 13, 2008

(54) FOLDING KNIFE WITH REMOVABLE BLADE

(75) Inventors: Kenneth J. Onion, Kaneohe, HI (US); Craig Green, Wilsonville, OR (US)

(73) Assignee: Kai U.S.A., Ltd., Tualatin, OR (US)

( * ) Notice: Subject to any disclaimer, the term of this patent is extended or adjusted under 35 U.S.C. 154(b) by 0 days.

(21) Appl. No.: 10/631,920

(22) Filed: Jul. 30, 2003

(65) Prior Publication Data

US 2004/0139613 A1 Jul. 22, 2004

Related U.S. Application Data

(60) Provisional application No. 60/399,772, filed on Jul. 30, 2002.

(51) Int. Cl.
*B26B 1/02* (2006.01)

(52) U.S. Cl. ..... 30/157; 30/331

(58) Field of Classification Search ..... 30/155, 30/156, 157, 158, 159, 160, 161, 329, 330, 30/331

See application file for complete search history.

(56) References Cited

U.S. PATENT DOCUMENTS

| | | | | | |
|---|---|---|---|---|---|
| 1,049,931 | A | * | 1/1913 | Smith | 30/157 |
| 1,087,342 | A | * | 2/1914 | Yerzley | 30/157 |
| 1,428,296 | A | | 9/1922 | Neft | |
| 1,706,251 | A | | 3/1929 | Perry | |
| 2,265,775 | A | | 12/1941 | McNamara | |
| 3,660,895 | A | | 5/1972 | West | |
| 3,829,967 | A | * | 8/1974 | Gilbert | 30/157 |
| 3,851,986 | A | | 12/1974 | Daughtry | 30/125 |
| 3,896,546 | A | | 7/1975 | Hildebrandt | 30/157 |
| 4,408,394 | A | | 10/1983 | Phelps | 30/157 |
| 4,439,922 | A | * | 4/1984 | Sassano | 30/161 |
| 4,442,600 | A | | 4/1984 | Felix-Dalichow | 30/161 |
| 4,730,393 | A | * | 3/1988 | Coburn | 30/153 |
| 4,918,820 | A | | 4/1990 | Korb et al. | 30/161 |
| 5,546,662 | A | | 8/1996 | Seber et al. | 30/161 |
| 5,797,188 | A | * | 8/1998 | Gilbert | 30/330 |
| 5,802,722 | A | | 9/1998 | Maxey et al. | 30/160 |
| 5,815,927 | A | | 10/1998 | Collins | 30/161 |
| 5,819,414 | A | | 10/1998 | Marifone | 30/160 |
| 5,937,527 | A | | 8/1999 | Okada | |
| 5,979,065 | A | | 11/1999 | Hsu | 30/519 |
| 6,026,575 | A | * | 2/2000 | Wonderley | 30/125 |
| 6,101,723 | A | * | 8/2000 | Ford | 30/157 |
| 6,134,788 | A | | 10/2000 | Chen et al. | 30/125 |

(Continued)

FOREIGN PATENT DOCUMENTS

FR 2 705 606 A1 12/1994

(Continued)

*Primary Examiner*—Hwei-Siu C. Payer
(74) *Attorney, Agent, or Firm*—Seed IP Law Group PLLC

(57) ABSTRACT

A knife is provided including a first side and a second side where the first side may be removably coupled to the second side. The knife further may include a blade removably secured to the handle and rotatable about a pivot point between an open position and a closed position. A manually-releasable fastening device disposed on the handle may be adapted to secure the first side to the second side and to secure the blade to the handle.

13 Claims, 4 Drawing Sheets

U.S. PATENT DOCUMENTS

| | | | | |
|---|---|---|---|---|
| 6,145,202 | A | 11/2000 | Onion | 30/160 |
| 6,154,965 | A | 12/2000 | Sakai | 30/161 |
| 6,345,202 | B2 | 2/2002 | Richmond et al. | 607/42 |
| 6,354,007 | B1 | 3/2002 | Scarla | 30/156 |
| 2002/0066187 | A1* | 6/2002 | Jennings | 30/161 |

FOREIGN PATENT DOCUMENTS

| | | |
|---|---|---|
| JP | 5-185381 | 7/1993 |
| JP | 9-277202 | 10/1997 |

* cited by examiner

FOLDING KNIFE WITH REMOVABLE BLADE

CROSS-REFERENCE TO RELATED APPLICATIONS

This application claims priority to U.S. Patent Application Ser. No. 60/399,772, filed Jul. 30, 2002 for a POCKET KNIFE WITH REMOVABLE BLADE, the disclosure of which is hereby incorporated by reference.

BACKGROUND

The present invention relates generally to folding knives, and more specifically, to a folding knife with a removable blade. Folding knives are disclosed in a number of U.S. patents, including U.S. Pat. Nos. 6,145,202, 5,802,722, and 5,815,927, the disclosures of which are hereby incorporated by reference. Knives with removable blades are shown in U.S. Pat. Nos. 1,706,251, 2,265,775, 3,851,986, 3,896,546, 4,408,394, 4,918,820, 5,979,065, 6,134,788, and 6,354,007, the disclosures of which are incorporated herein by reference for all.

SUMMARY

A knife is provided including a first side and a second side where the first side may be removably coupled to the second side. The knife further may include a blade removably secured to the handle and rotatable about a pivot point between an open position and a closed position. A manually-releasable fastening device disposed on the handle may be adapted to secure the first side to the second side and to secure the blade to the handle.

The advantages of the present invention will be understood more readily after a consideration of the drawings and the Detailed Description.

DETAILED DESCRIPTION

Figure 1:
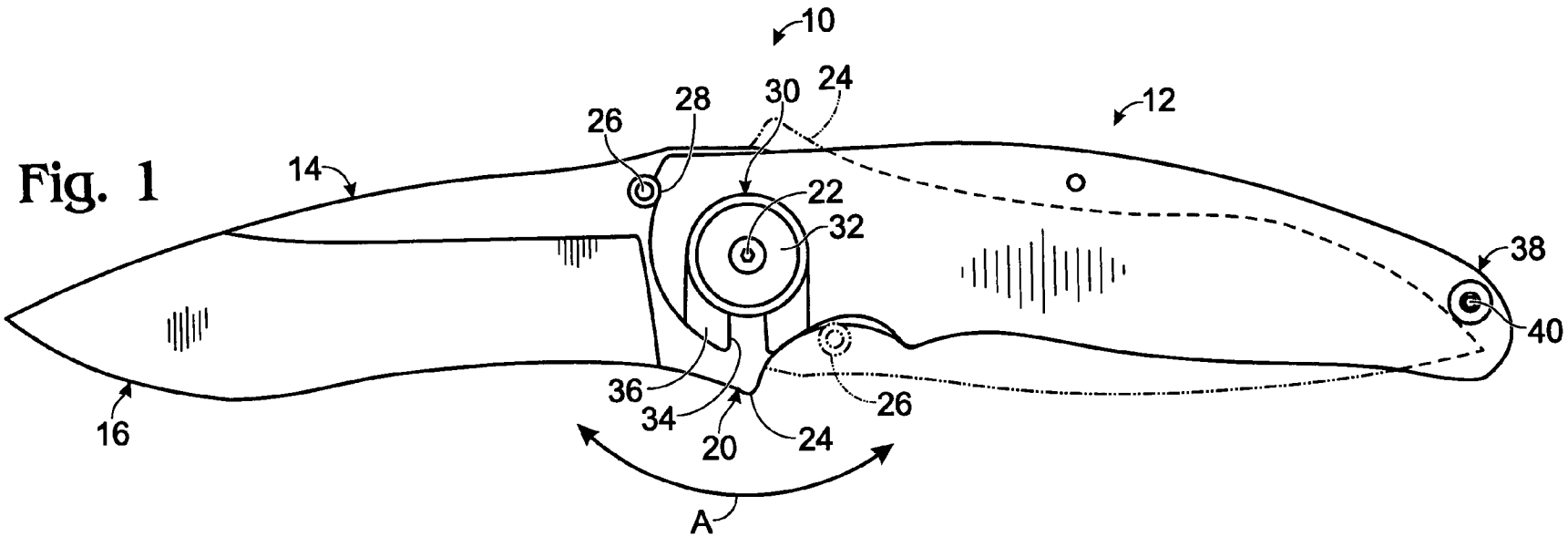
FIG. 1 is a side view of a folding knife according to an embodiment of the present disclosure.

Referring to the drawings, and more specifically to FIG. 1, a folding knife according to an embodiment of the present disclosure is shown generally at 10. Folding knife 10 includes a handle 12 and a blade 14. Distal end 16 of blade 14 typically includes a sharp point or tip 18, but may include a blunt end or other tool head. In some embodiments, the blade may be serrated or notched. Blade 14 may be adapted to be folded or otherwise positioned in an open position, where the blade substantially extends from the handle as shown in solid lines in FIG. 1 and a closed position where at least a portion of the blade is received within the handle as shown by the dashed lines in FIG. 1.

In the illustrated embodiment, blade 14 may include a tang 20 that may be pivotally connected to handle 12 at a pivot point 22. Blade 14 may be adapted to pivot about pivot point 22 between an open (fully-extended) position and a closed position as indicated by the arrow A. Although only an open fully-extended position and a closed position are illustrated, it should be appreciated that in some embodiments, the knife may be positioned in any number of various open and/or closed positions.

Blade 14 further may include a tang-protruding portion 24. Tang-protruding portion may protrude from handle 12 when the blade is in a closed position. Tang-protruding portion 24 may be adapted to aid a user in opening blade 14 from the closed position. For example, a user may push protruding portion 24 into the handle, thereby urging blade 14 out of handle 12 into the open position. Blade 14 also may include a thumb stud 26 located on one or both sides of blade 14. Thumb stud 26 may allow a user to apply a force to blade 14 further aiding in opening and/or closing of the blade. Such features may be useful in one-handed assisted-opening devices and are further described in U.S. Pat. Nos. 6,145,202 and 5,802,722, the disclosures of which are incorporated by reference above.

It should be appreciated that the blade may be maintained in the open position by any suitable locking or retention mechanisms. For example, liner locks, sliding locks, spring locks, etc. may be used to retain the blade in a selected position. Additionally, the handle may include features which further operate to lock the blade in an open position. For example, handle 12 may have an indentation 28 adapted to receive thumb stud 26 of blade 14 when the blade is in the open position. Indentation 28 may act as a stop for blade 14 preventing the blade from being moved or rotated beyond the fully-extended open position. Thus, in the open position, thumb stud 26 is cradled within indentation 28 of handle 12.

A fastening device 30 disposed on the handle may be adapted to secure the first side piece to the second side piece and to secure the blade to the handle. Additionally, fastening device 30 may be adapted to simultaneously secure blade 14 to handle 12, and secure various handle components. For example, blade 14 may be removably secured to handle 12 by a manually-releasable fastening device 30. In some embodiments, including the embodiment shown in FIG. 1, fastening device 30 may be disposed about pivot point 22 on the front end of handle 12. Regardless of location, fastening device 30 may be adapted to be manually released. Thus, fastening device 30 may be released by the user's hand. As used herein, a manually-releasable fastening device or manipulable device includes a device that may be operated by using human force rather than mechanical force. Human force includes operation or control by skilled use of hands. For example, a manually-releasable fastening device may include a fastener adapted to be released without the use of machines or tools, such as, but not limited to, screwdrivers, wrenches, pliers, etc.

In the embodiment of FIG. 1, fastening device 30 is shown to include a knob 32. Knob 32 may be a manipulable switch, dial, collar, socket, or lever. For example, knob 32 may be any suitable manually-releasable fastening device, including, but not limited to a push pin, a clamp, a spring, etc. Manipulation of knob 32 may include rotation of the knob by the hand of the user. Rotation may effectively disengage the fastening device 30 from the handle, and consequently enable the blade to be released from the handle. Counter-rotation of knob 32 may function to secure the blade to the handle.

In the embodiment shown in FIG. 1, handle 12 is adapted to interact with fastening device 30. For example, handle 12 may include a receiving slot, also referred to herein as a handle slot 34, located on the handle. The receiving slot may be adapted to engage a portion of the fastening device.

A seat 36 for fastening device 30 may be substantially adjacent the receiving slot of the handle. For example, seat 36, also referred to as a seat, may substantially surround or extend along one or both sides of the handle slot 34. The seat may be a recessed portion within the handle, such that the surface of the seat is below the plane of the handle. Seat 36 may be adapted to receive a portion of fastening device 30. For example, knob 32 may be rotated onto seat 36 so as to secure blade 14 to handle 12.

As described in more detail below, handle 12 may further include a rear connector 40 located at a rear end 38 of handle 12, where rear end 38 is distal to pivot point 22. The rear connector may act to secure the components of the handle together. It should be noted that rear connector 40 may be capable of being selectively released to enable assembly/disassembly of handle 12.

Figure 2:
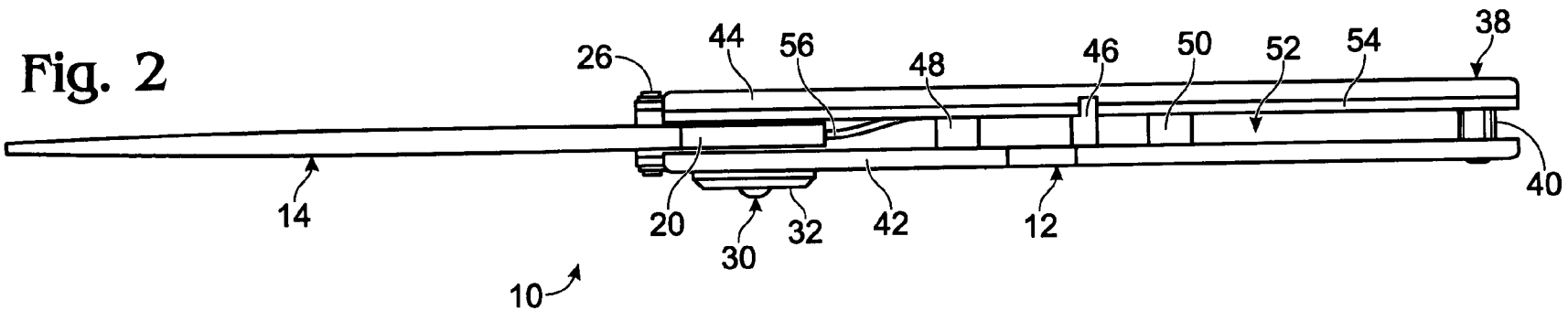
FIG. 2 is a top view of the folding knife of FIG. 1.

Referring to FIG. 2, handle 12 may include a first side or first side piece 42 and a second side or second side piece 44. The first side piece may be removably coupled to the second side piece. The side pieces may be linked by a plurality of connectors and/or spacers. For example, the side pieces may be spaced apart by a mid-anchor connector 46, and spacers 48 and 50 which may be attached to one or both sides of handle 12. The connectors/spacers may define a hollow region or blade-receiving space 52 for receiving a portion of blade 14 when blade 14 is in a closed position relative to handle 12.

As briefly described above, first side piece 42 and second side piece 44 of handle 12 may be additionally connected by a rear connector 40 substantially disposed toward the rear end 38 of handle 12. Rear connector 40 is shown to be a pin connector but may also be a bolt, a screw, a rivet, or any fastening device, and may be adapted to be released manually. It should be appreciated that other connectors may function in a similar manner as rear connector 40.

In some embodiments, a liner 54 may be disposed adjacent one or both of the side pieces such that the liner is positioned adjacent hollow region 52. Liner 54 may include a displaceable portion 56 that may operate to lock blade 14 in an open position. The displaceable portion may be biased such that the displaceable portion may move into the path of blade 14 once blade 14 has moved to a substantially-open position. The displaceable portion thus operates as a liner lock. Closing blade 14 may include disengaging or otherwise moving displaceable portion 56 of liner 54 out of the path of blade 14. These features are further described in U.S. Pat. Nos. 6,145,202 and 5,802,722, which are incorporated by reference above.

Figure 3:
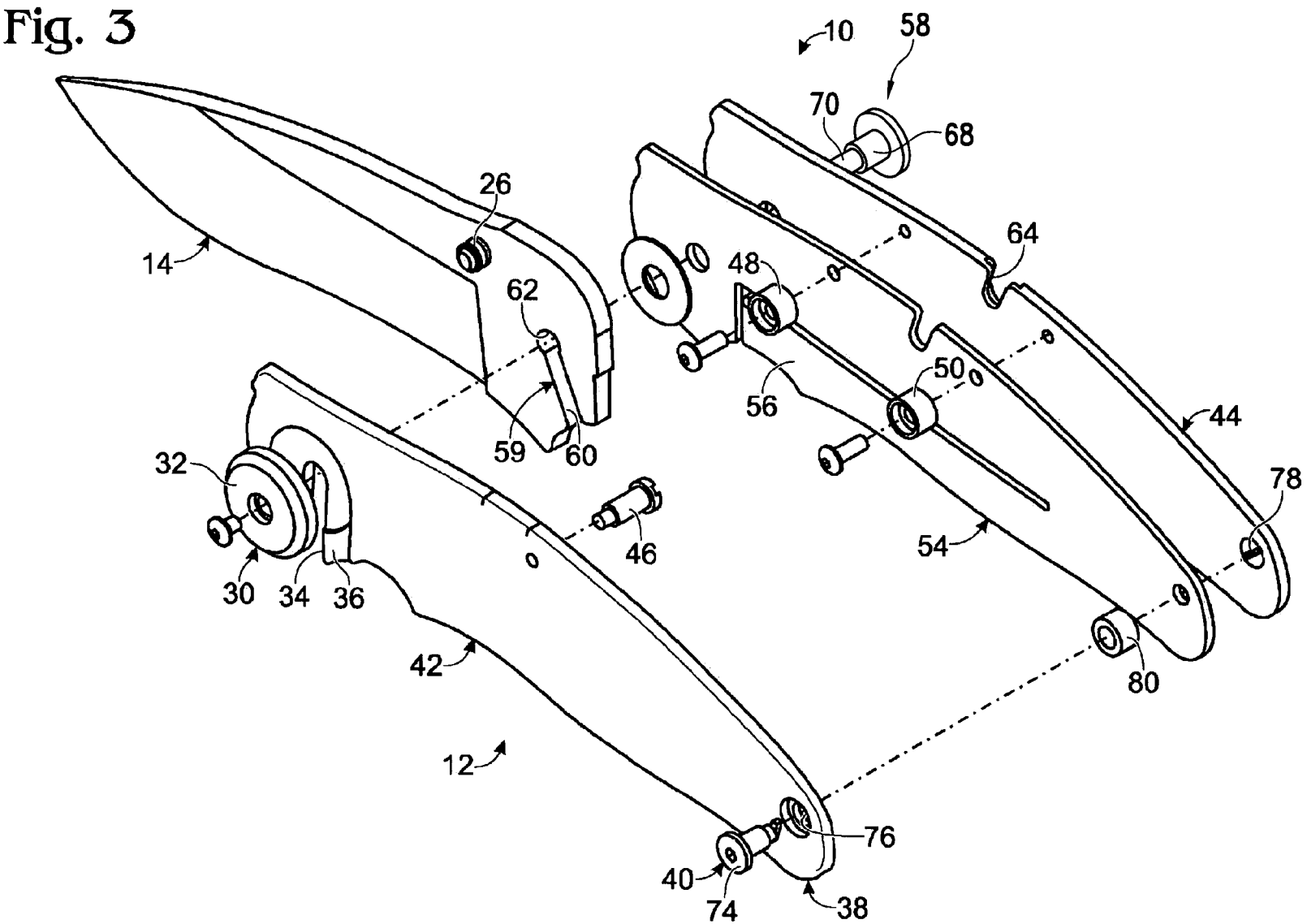
FIG. 3 is an exploded isometric view of the folding knife of FIG. 1 shown in the open position.

FIG. 3 further illustrates the components of knife 10. As described above, knife 10 includes a handle 12 including a plurality of connectors/spacers, such as mid-anchor connector 46, spacers 48, 50, rear connector 40, etc. The connectors/spacers may be any suitable pin, screw, bolt, etc. that operate to define a blade-receiving space or hollow region 52 linking the sides of the handle together. For example, mid-anchor connector 46 may couple the mid-region of the handle side pieces 42, 44 together by fitting into a receiving cavity 64 within handle side piece 44.

As described briefly above, knife 10 may include a fastening device 30 adapted to secure the blade to the handle. Fastening device 30 may include a knob or other hand-operable portion which may be coupled with a retention pin or post 58. It should be appreciated that in the present embodiment, retention post 58 is adapted to releasably engage knob 32. In some embodiments, retention post 58 may be threaded such that knob 32 securely engages the post. For example, in FIG. 5 a portion of retention post 58 is threaded (as shown at 66). Knob 32 may include a corresponding threaded portion (not shown) adapted to engage the threads on retention post 58.

In some embodiments, blade 14 may pivot about retention post 58 between an open and a closed position. Retention post 58 may further function to couple handle side pieces 42 and 44 together. For example, retention post 58 may extend through holes/slots in each of the handle pieces, the liner, and the blade. Specifically, blade 14 may include an inlet 59, which includes a blade slot 60 and a receptacle 62. Inlet 59 is adapted to engage at least a portion of fastening device 30. Specifically, blade 14 may engage retention post 58 via blade slot 60 in the tang of the blade. Blade slot 60 may terminate in a receptacle 62 which may be adapted to be seated around retention post 58 as described in more detail below.

Figure 4:
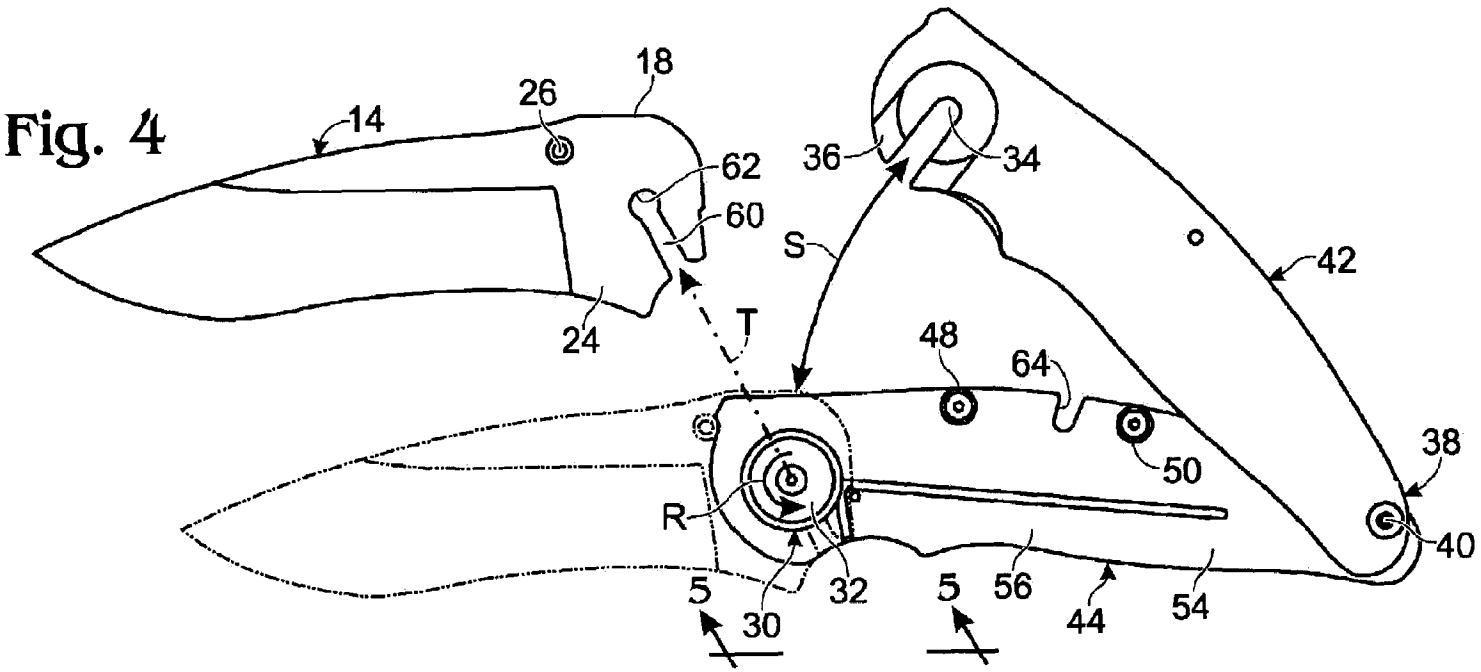
FIG. 4 is a side view of the folding knife of FIG. 1 showing partial disassembly of the knife.
Figure 5:
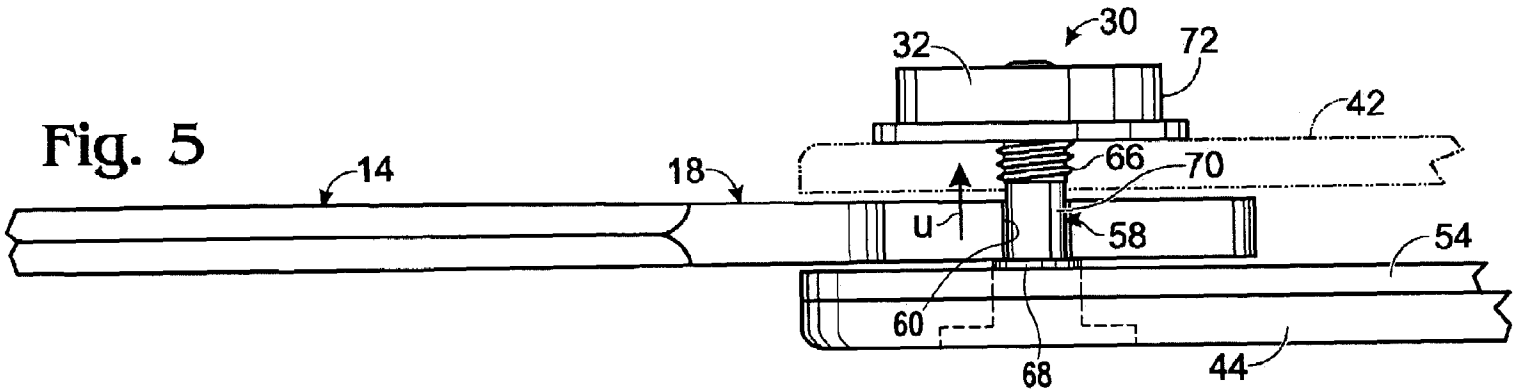
FIG. 5 is an enlarged fragmentary bottom view of a portion taken along line 5-5 of the folding knife shown in FIG. 4.

FIG. 4 illustrates a method of manual assembly/disassembly of blade 14 from handle 12. To remove blade 14 from handle 12, fastening device 30 may be manually released from an engaged position. The handle pieces and blade are in an engaged position when they are secured in an operable fashion by the fastening device. In the embodiment shown, release of fastening device 30 may be achieved by turning knob 32 in a counter-clockwise direction, as indicated by arrow R. Rotation of knob 32 in the counter-clockwise direction enables knob 32 to disengage from retention post 58. Specifically, as shown in FIG. 5, rotation of knob 32 causes knob 32 to rise upwards on a threaded portion 66 of post 58. It should be noted that while the direction indicated for rotation of knob 32 is in the counter-clockwise direction, it is possible that device 30 may alternatively be released from the engaged position by clockwise rotation of knob 32. Moreover, other mechanisms for releasing knob 32 may be used without departing from the scope of the invention.

The release of knob 32 results in the disengagement of the knob from seat 36 on the side piece of the handle. Detachment of the knob from the seat enables first side 42 of the handle to be rotated or pivoted away from the fastening device, thus disengaging first side 42 from retention post 58 of fastening device 30. Specifically, handle slot 34 is adapted to slide off or away from retention post 58. Because seat 36 is recessed relative to the plane of the handle side piece, the handle is able to smoothly rotate under knob 32 away from fastening device 30. Rotation of handle side 42 away from handle side 44 is illustrated by arrow S in FIG. 4.

After rotation of handle side 42 from handle side 44, the blade may be disengaged from the fastening device. As described in more detail in relationship to FIG. 5, the blade may be slid off of or otherwise disconnected from retention post 58 of fastening device 30. Removal of blade 14 from fastening device 30 is indicated by dashed arrow T.

Referring to FIG. 5, retention post 58, shown partially by hidden lines, may include a base 68 and a neck 70. The circumference of base 68 may be greater than the circumference of neck 70. Receptacle 62 of blade 14 is sized to receive base 68. When base 68 is received within receptacle 62, and clamped within the side pieces of the handle via fastening mechanism 30, blade 14 is unable to slide off of post 58 because blade slot 60 is sized to prevent base 68 from passing through slot 60.

Removal of blade 14 from retention post 58 may include moving blade 14 upward in direction of arrow U and onto the comparatively narrower neck 70 of retention post 58. Although blade slot 60 is too narrow to allow base 68 to pass through, blade slot 60 may be sized such that neck 70 may pass through. Thus, upward movement of blade 14 aligns slot 60 with neck 70 such that the blade may be slid off of neck 70 and removed from retention post 58.

FIG. 5 further illustrates optional features of knob 32. For example, in some embodiments, knob 32 may include friction grips 72 which may be adapted to assist a user in the release of the fastening device. For example, the friction grips may enable a user to more easily turn knob 32 by hand without the use of any tools.

Figure 6:
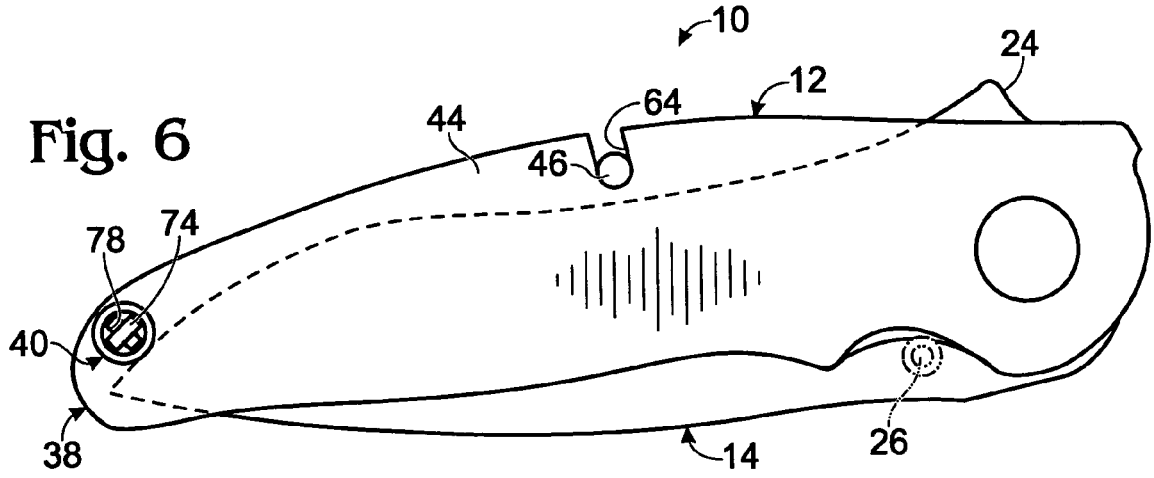
FIG. 6 is a side view of the folding knife of FIG. 1 with the blade in a closed position.

It should be noted that in some embodiments, the handle side pieces 42, 44 may be assembled/disassembled manually. For example, and as discussed above, the side pieces of the handle may be coupled via a rear connector 40. Referring back to FIG. 3, rear connector 40 may include a pin 74 which may extend through a receiving aperture 76 in the first side piece or the second side piece of the handle. For example, pin 74 may pass through receiving aperture 76 in side piece 42, through a spacer 80 and an aperture in liner 54 to a pin slot 78 on the other side piece 44. FIG. 6 illustrates the position of the pin relative the pin slot when the knife is assembled. Specifically, pin 74 extends substantially transverse to or otherwise off set from the pin slot 78 such that the first and second side handles are secured together.

FIG. 6 further illustrates mid-anchor 46 positioned within receiving cavity 64. It should be appreciated that the receiving cavity is shaped to enable the rotation of the handle side piece and mid-anchor 46 out of receiving cavity 64.

Figure 7:
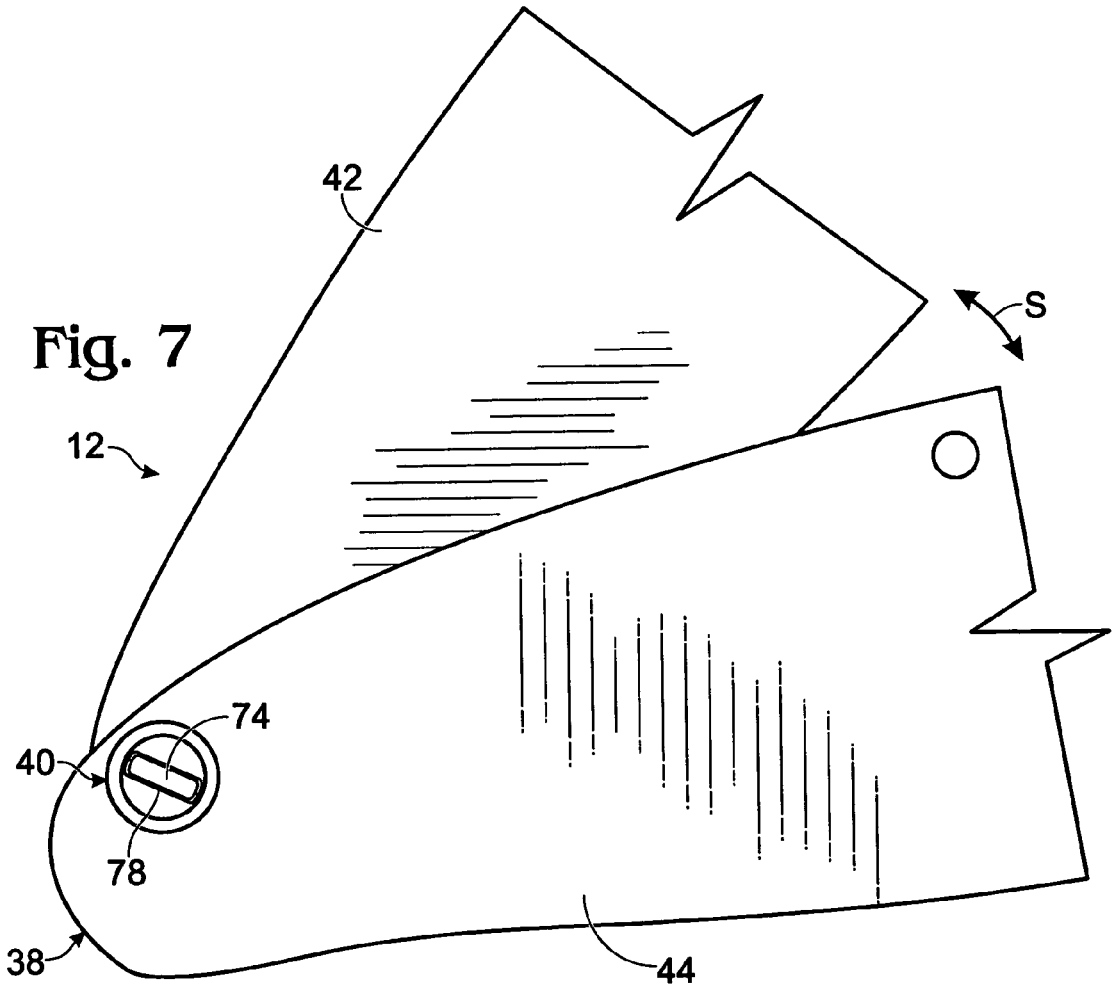
FIG. 7 is an enlarged fragmentary isometric view of the opposing side of the folding knife of FIG. 4.

FIG. 7 illustrates a method of manually disengaging the first side piece from the second side piece. Specifically, FIG. 7 shows first side piece 42 rotated relative to second side piece 44. In the rotated position, pin 74 aligns with pin slot 78 such that pin 74 may pass through pin slot 78, thus enabling the separation of the first side piece from the second side piece.

Assembly of the knife generally follows the reverse of the disassembly method described above. For example, assembly of the knife may include aligning the two handle pieces in the rotated position shown in FIG. 7. Thus, in the illustrated embodiment, the side pieces may be positioned such that pin 74 may be inserted into pin slot 78 thereby securing the handle pieces together.

The blade may be attached to the handle by positioning the blade slot 60 over the neck 70 of retention post 58. Receptacle 62 of blade 14 may be seated onto the base 68 of retention post 58. Upon rotation of the two handle pieces into parallel alignment (such as shown in FIG. 3), retention post 58 post may be received within handle slot 34 of handle piece 42. A user may then align and secure knob 32 to retention post 58, thereby securing the knife blade to the handle. It should be appreciated that rotation of the handle pieces into alignment causes pin 74 to rotate perpendicular to pin slot 78, thus preventing the disengagement of handle side pieces from each other.

Although the invention has been disclosed in its preferred forms, the specific embodiments thereof as disclosed and illustrated herein are not to be considered in a limiting sense, because numerous variations are possible. The subject matter of the invention includes all novel and non-obvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to any earlier claims, also are regarded as included within the subject matter of the invention.

We claim:

1. A knife comprising:

a handle having first and second sides;

a retention post extending between the first and second sides of the handle at a first end thereof, the first side of the handle being configured to be disengageable from the retention post, and rotatable, with respect to the second side of the handle, about a first axis located at a second end of the handle, between an engaged position, in which the first side is engaged with the retention post, and a disengaged position, in which the first side is disengaged from the retention post; and a removable blade having a tang that includes an inlet with a slot configured to engage the retention post, the blade configured to rotate, relative to the handle, about a second axis parallel to the first axis and defined by the retention post; and a knob coupled to the retention post and rotatable between a locked and an unlocked position, and configured such that the knob must be rotated away from the locked position in order to remove the blade from the handle.

2. The knife of claim 1 wherein:

the blade comprises a receptacle at an end of the slot and having a width greater than a width of the slot;

the retention post comprises a neck having a diameter smaller than the width of the slot and a base having a diameter greater than the width of the slot and smaller than the width of the receptacle; and the receptacle of the blade is configured to engage the base of the retention post.

3. The knife of claim 2 wherein, while the first side of the handle is disengaged from the retention post and rotated to the disengaged position, the receptacle of the blade can be moved between engaged with, and disengaged from, the base of the retention post, and, while the first side of the handle is rotated to the engaged position and engaged with the retention post, the receptacle of the blade cannot be moved between engaged with, and disengaged from, the retention post.

4. The knife of claim 1 wherein, while the first side of the handle is disengaged from the retention post and rotated to the disengaged position, the first side of the handle can be disengaged from the second side of the handle.

5. The knife of claim 1, further comprising a knob coupled to the retention post and rotatable between a locked and an unlocked position, and configured such that, while the knob is in the locked position and the first side of the handle is engaged with the retention post, the first side of the handle cannot be disengaged from the retention post or rotated away from the engaged position.

6. A knife comprising:

a handle including a first side and a second side;

a blade having a tang with a slot terminating in a receptacle, the blade being removably secured to the handle and rotatable between an open and a closed position; and a manually-releasable fastening device having:

a retaining element including a retention post, the retention post having a neck and a base, the base being sized to be engaged by the receptacle of the blade, and a manipulable element having a knob and being adjustably attached to the retaining element and adapted to releasably engage the handle, such that adjustment of the manipulable element relative to the retaining element enables removal of the blade from the handle and rotation of the first side relative to the second side.

7. A knife comprising:

a handle including a first side and a second side;

a blade configured to rotate about a pivot point between an open position and a closed position and having a tang with an inlet including a slot terminating in a receptacle, the blade being removably secured to the handle; and a manually-releasable fastening device adapted to releasably engage the first and second sides of the handle and the blade such that, while the fastening device is released, the first side is separable from, and rotatable relative to, the second side so that the blade is removable from the handle.

8. The knife of claim 7, wherein said manually-releasable fastening device is disposed about the pivot point.

9. The knife of claim 7, wherein the fastening device includes a knob and a retention post.

10. The knife of claim 9, wherein the knob includes friction grips.

11. The knife of claim 9, wherein the inlet of the blade is adapted to engage the retention post of the manually-releasable fastening device.

12. The knife of claim 11, wherein the retention post has a neck and a base, the base being sized to be engaged by the receptacle of the blade.

13. The knife of claim 7, wherein the first side and the second side include a connector adapted to release the first side from the second side when the first side and the second side are in a rotated position.

* * * * *